US012550988B2

(12) United States Patent
Adelchanow et al.

(10) Patent No.: US 12,550,988 B2
(45) Date of Patent: Feb. 17, 2026

(54) BI-FOLD WALLET INCORPORATING ELECTROMAGNETIC SHIELDING

(71) Applicants: Nicolas Adelchanow, Santa Barbara, CA (US); Ramsey Carter, Goleta, CA (US); Ryan Thomas, Santa Barbara, CA (US); Peter Ducato, Santa Barbara, CA (US)

(72) Inventors: Nicolas Adelchanow, Santa Barbara, CA (US); Ramsey Carter, Goleta, CA (US); Ryan Thomas, Santa Barbara, CA (US); Peter Ducato, Santa Barbara, CA (US)

( * ) Notice: Subject to any disclaimer, the term of this patent is extended or adjusted under 35 U.S.C. 154(b) by 30 days.

(21) Appl. No.: 18/207,793

(22) Filed: Jun. 9, 2023

(65) Prior Publication Data

US 2024/0407514 A1 Dec. 12, 2024

(51) Int. Cl.

| | |
|---|---|
| ***A45C 11/18*** | (2006.01) |
| ***A45C 1/06*** | (2006.01) |
| ***A45C 11/00*** | (2006.01) |

(52) U.S. Cl.

CPC ..... *A45C 11/182* (2013.01); *A45C 1/06* (2013.01); *A45C 11/002* (2025.01); *A45C 2011/186* (2013.01)

(58) Field of Classification Search

CPC .... A45C 11/182; A45C 1/06; A45C 2011/186
See application file for complete search history.

(56) References Cited

U.S. PATENT DOCUMENTS

| | | | | |
|---|---|---|---|---|
| 10,709,044 | B1 * | 7/2020 | Judy | H05K 9/0009 |
| 11,311,087 | B2 * | 4/2022 | Del Moral | A45C 11/321 |
| 2007/0131323 | A1 * | 6/2007 | Stewart-Stand | A45C 13/00 150/131 |
| 2007/0289775 | A1 * | 12/2007 | Potts | G06K 19/07327 174/350 |
| 2012/0195530 | A1 * | 8/2012 | Kennedy | H04B 15/00 383/107 |
| 2014/0034520 | A1 * | 2/2014 | Scicluna | G06K 19/07327 150/132 |
| 2015/0157101 | A1 * | 6/2015 | Wylan | A45C 1/06 150/132 |
| 2016/0053525 | A1 * | 2/2016 | McMurray | E05G 1/06 150/130 |
| 2016/0324282 | A1 * | 11/2016 | Kilkenny | A45C 15/08 |

(Continued)

OTHER PUBLICATIONS

Tasmanian RFID Wallet: https://www.amazon.com/Tasmanian-Tiger-Rfid-Wallet-Black/dp/B00NU2XM8W (Year: 2015).*

(Continued)

*Primary Examiner* — Nathan J Jenness
*Assistant Examiner* — Justin Caudill
(74) *Attorney, Agent, or Firm* — Philip Virga

(57) ABSTRACT

A bi-fold wallet is provided for securely storing RFID contactless cards from RFID skimming by incorporating multiple sheets of a faraday fabric which are then layered, bound, and attached within the interior of the bi-fold wallet for enabling the blocking of all electromagnetic signals including Wi-Fi, GPS, Bluetooth, Cellular 5G, Radio and RFID and others. Additionally, in the unfolded position the bi-fold wallet defines an interiorly defined faraday bag for housing a smartphone.

1 Claim, 4 Drawing Sheets

(56) References Cited

U.S. PATENT DOCUMENTS

| | | | | |
|---|---|---|---|---|
| 2017/0303650 | A1* | 10/2017 | Cohen | A45C 1/06 |
| 2018/0110305 | A1* | 4/2018 | Kim | A45C 1/06 |
| 2019/0266463 | A1* | 8/2019 | Wang | A45C 11/182 |
| 2020/0000190 | A1* | 1/2020 | Grafilo | A45C 11/182 |
| 2021/0251357 | A1* | 8/2021 | Zar | A45C 11/002 |

OTHER PUBLICATIONS

Travel Lambo RFID Wallet: https://www.amazon.com/Travelambo-Wallet-Bifold-Zipper-Credit/product-reviews/B0DMFS994M (Year: 2019).*

Wanty: Water-Dust resistant cover. https://www.amazon.com/Wanty-Water-Resistant-Waterproof-Dust-Proof-Electric/dp/B0C5XFZLCP (Year: 2023).*

Xtreme Sight Line: Diamond Form Faraday Fabric https://www.amazon.com/Xtreme-Sight-Line-Interwoven-high-Shielding/dp/B093TT9C65?th=1 (Year: 2021).*

* cited by examiner

BI-FOLD WALLET INCORPORATING ELECTROMAGNETIC SHIELDING

TECHNICAL FIELD

The present invention relates generally to the field of electromagnetic shielding enclosures. More particularly, the present invention relates to using a wallet as an RF-shielded enclosure which provides a multifunction bi-fold wallet that defines in an unfolded position a faraday bag for housing and protecting a smartphone.

BACKGROUND

A Faraday cage or Faraday shield is an enclosure used to block electromagnetic fields. A Faraday shield may be formed by a continuous covering of conductive material, or in the case of a Faraday cage, by a mesh of such materials. Faraday bags are a type of Faraday cage made of flexible metallic fabric. Faraday bags may be used by the public to protect against data theft or to enhance a person's digital privacy with respect to their electronic devices.

RF shielded wallets are designed to protect a person's credit cards and identity from RFID skimming, a type or form of digital pickpocketing. RFID stands for radio-frequency identification, which uses electromagnetic fields to identify and track tags attached to objects. RFID-enabled credit cards, also known as contactless cards, are vulnerable to skimming, wherein thieves use an RFID reader to wirelessly steal the person's credit card information through their wallet.

In use RF shielded wallets incorporate a shielding material that blocks the electromagnetic signal thereby preventing skimming attempts. More specifically, materials used in prior art RF shielded wallets range from blocking films which are typically placed in the lining of the wallet to help prevent radio frequency signals from penetrating through or alternatively use just a slim piece of aluminum foil which although is a very cost-effective option to line the wallet, the inside layering of aluminum foil may help to block some but not all electromagnetic radiation. Lastly, prior art shielded wallets do not provide an effective solution for additionally protecting a user's smartphone from RFID skimming.

The bi-fold wallet of the current invention solves the problem of unauthorized and/or inadvertent theft of contactless cards and smartphones by blocking all electromagnetic fields when housed within the bi-fold wallet of the current invention.

SUMMARY

A bi-fold wallet is provided for securely storing RFID contactless cards from RFID skimming by incorporating multiple sheets of a faraday fabric which are then layered, bound, and attached within the interior of the bi-fold wallet for enabling the blocking of all electromagnetic signals including Wi-Fi, GPS, Bluetooth, Cellular 5G, Radio and RFID. Additionally, in the unfolded position the bi-fold wallet defines an interiorly defined faraday bag for housing a smartphone.

BRIEF DESCRIPTION OF THE DRAWINGS

A more detailed understanding may be had from the following description, given by way of example in conjunction with the accompanying drawings wherein.

DETAILED DESCRIPTION

In today's high-tech environment, credit cards, debit cards, key fobs and other electronic devices transmit electronic signals containing personal information. Accordingly, the possibility of unauthorized collection of this information occurs. Electromagnetic (EM) shielding is the practice of surrounding electronics and cables with conductive or magnetic materials to guard against incoming or outgoing emissions of electromagnetic frequencies (EMF). This shielding practice involves surrounding electronics and cables with conductive or magnetic materials to prevent theft of electronic transmissions. Electromagnetic shielding that blocks radio frequency (RF) electromagnetic radiation is also known as RF shielding. Electromagnetic shielding also blocks magnetic frequency (MF) transmissions also known as MF shielding.

Figure 1:
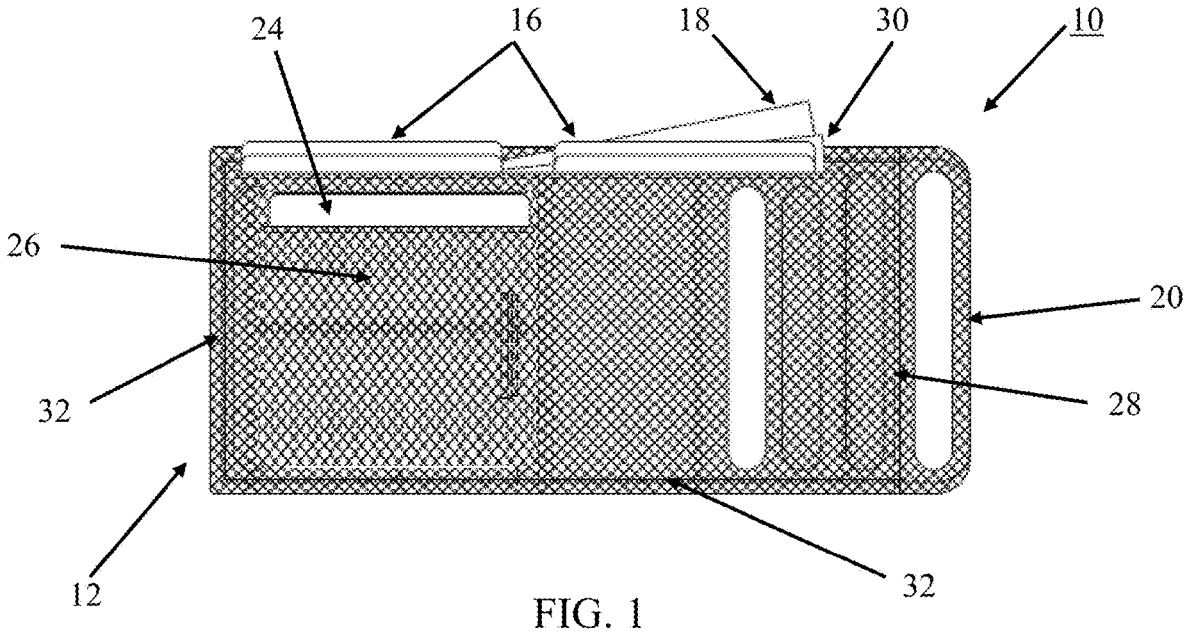
FIG. 1 is a front view of the Bi-fold wallet defining a side folding flap in accordance with the present invention.
Figure 2:
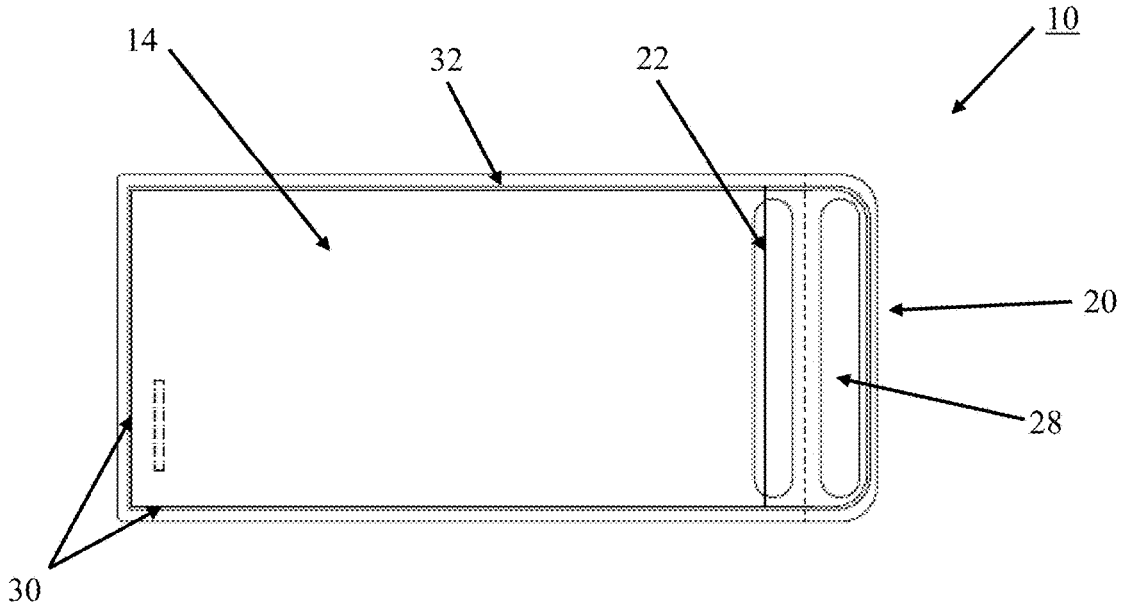
FIG. 2 is a back view of the Bi-fold wallet shown in FIG. 1 of the present invention.

Referring now to FIGS. 1 and 2, there is shown and illustrated a bi-fold wallet 10 in the unfolded position used for carrying and housing items typically including personal identification, contactless credit cards 16 and/or currency 18. The bi-fold wallet 10 may be carried containing RF emitting debit/credit cards 16 while being protected against any RF hacking attempts. The bi-fold wallet 10 may be comprised of portions, such as a front portion 12 and a back portion 14. These portions 12 and 14, respectively may comprise an outer material on the exterior, an inner material on the interior containing an RF blocking technology that is layered between a soft filler material attached to the inner material, and the outer material as will be more fully described below.

Turning once again to FIGS. 1 and 2, the bi-fold wallet 10 is typically formed using the prior art technique of cutting two rectangular pieces a front portion 12 and back portion 14, respectively of material with equal dimensions. Next, one of the rectangular pieces of the material is folded in half (width-wise) to create the bi-fold wallet's 10 main body. In accordance with the present invention. These portions 12 and 14, respectively may comprise an outer material which in a preferred embodiment is a water and dust proof nylon ripstop. The interior of the bi-fold wallet 10 is formed using inner materials 26 which are layered, bind and attached to the interior of the back of each side of the front and back portions layers containing an RF blocking technology of a Faraday nickel copper alloy mesh that is layered and covered with a diamond Faraday material to the inner material to prevent abrasion.

The two rectangular pieces 12 and 14 with the layered Faraday nickel copper mesh and diamond Faraday material 26 are now all stitched together using a needle and thread (not shown). It should be noted that the stitching is evenly spaced and as close together as possible so that the stitching is tight. One or more interior slots are now added into the newly formed interior of the bi-fold wallet 10 for housing credit cards 16 wherein an exterior longitudinal pocket 24 is created along the front side of one of the rectangular pieces 12 such that the pocket 24 may be used for storing a frequently used credit or debit card. Lastly the assembly of the bi-fold wallet 10 forms a folding flap portion 20 at one end of the bi-fold wallet 10 as shown in FIGS. 12 and 14.

Figure 5:
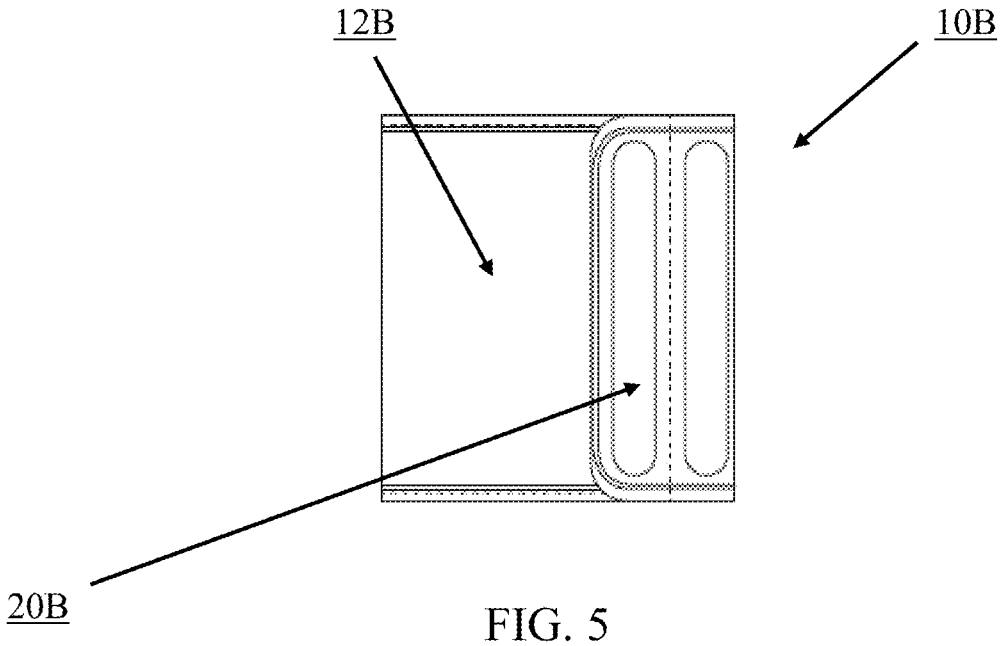
FIG. 5 is a front view of the Bi-fold wallet in the folded position with the side folding flap in the closed position in accordance with the present invention.
Figure 6:
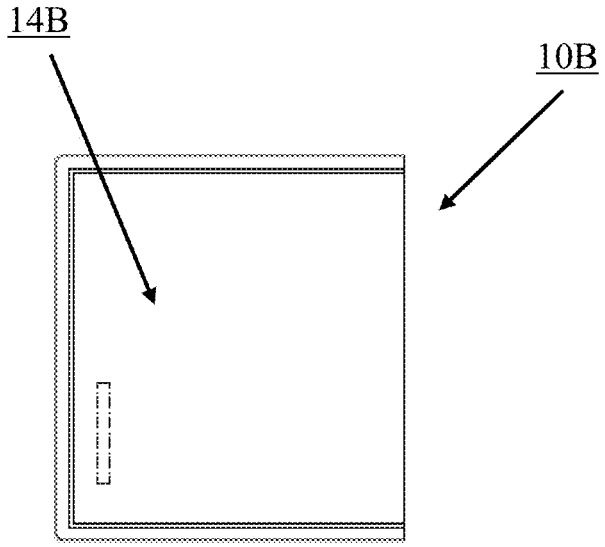
FIG. 6 is a back view of the Bi-fold wallet shown in FIG. 5 in the folded position in accordance with the present invention.

It should be understood that the size of the rectangular pieces 12 and 14 with the layered Faraday nickel copper mesh and diamond Faraday material 26 determines the size of the bi-fold wallet 10 created. By way of example but not of limitation, in one preferred embodiment a folded wallet 20 would define a length of 4.5 Inches, a width of 4 inches and a thickness of ½ inch as shown in FIGS. 5 and 6. Additionally, by way of example but not of limitation, in another preferred embodiment, an unfolded wallet 10 would define a length of 8 inches, a width of 4.5 inches, and a thickness of ⅛ inch as illustrated in FIGS. 1 and 2. The folding flap portion 20 folds along a folding line 22 as shown in FIG. 2.

When stitching the two rectangular pieces 12 and 14 with the layered Faraday nickel copper mesh and diamond Faraday material 26 together two interior compartments are formed. The first interior compartment defines a first longitudinal compartment 30 for housing cash 18 and credit cards 16 as shown in FIG. 1. The second interior compartment defines a second longitudinal compartment 28 for housing a smartphone with the bi-fold wallet 10 when it is in the unfolded position. More specifically, the second longitudinal compartment defines a faraday cage.

Figure 3:
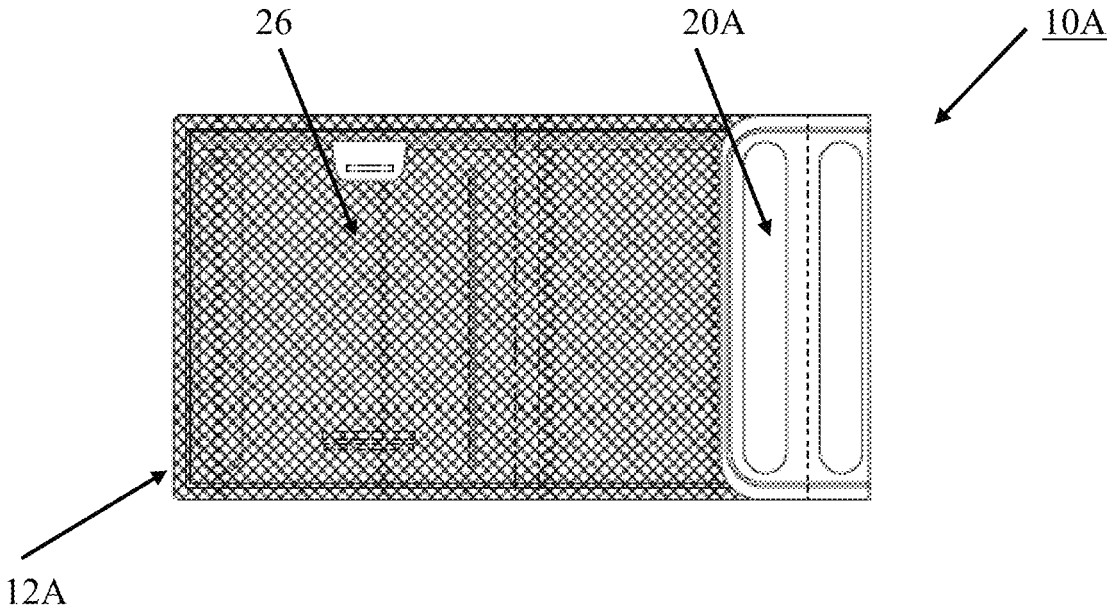
FIG. 3 is a front view of the Bi-fold wallet in the unfolded position shown in FIG. 1 illustrating the wallet size when the side folding flap is in the closed position in accordance with the present invention.
Figure 4:
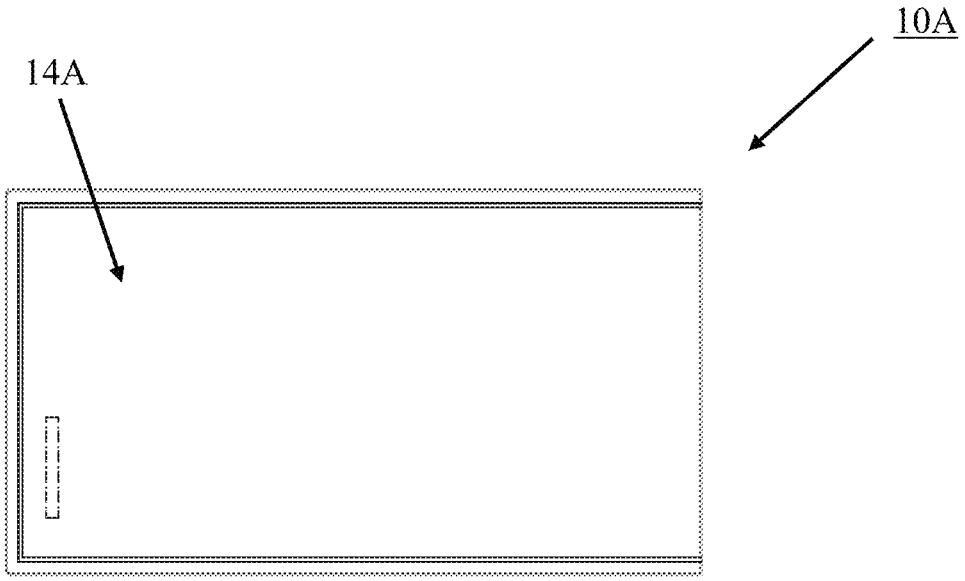
FIG. 4 is a back view of the Bi-fold wallet shown in FIG. 3 illustrating the wallet size when the side folding flap is closed in accordance with the present invention.

Referring now to FIGS. 3 and 4, there is shown and illustrated the bi-fold wallet 10A in the unfolded position with the front portion 12A and back portion 14A illustrating the wallet size when the folding flap 20 is in the closed or in the folded position interiorly housing the layered Faraday nickel copper mesh and diamond Faraday material 26 in accordance with the present invention. Referring now to FIGS. 5 and 6, there is shown and illustrated the front portion 12B and back portion 14B of the bi-fold wallet 10B when the side folding flap 20B is in the folded position.

Figure 7:
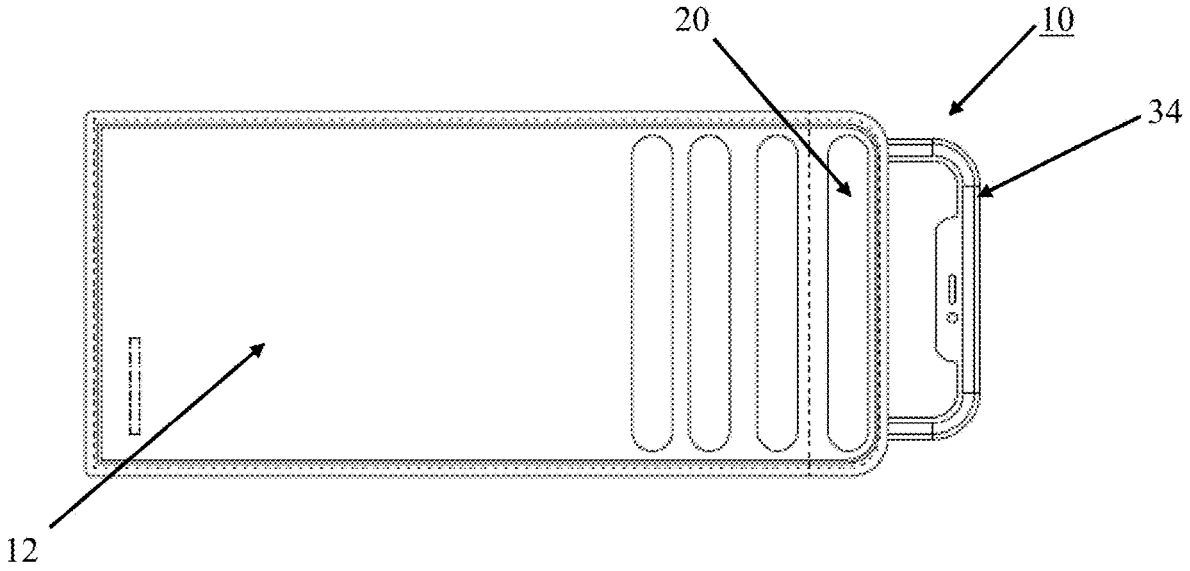
FIG. 7 is a front view of the Bi-fold wallet in the unfolded position illustrating the insertion of a smartphone into a faraday bag portion of the bi-fold wallet for housing the smartphone in accordance with the present invention.
Figure 8:
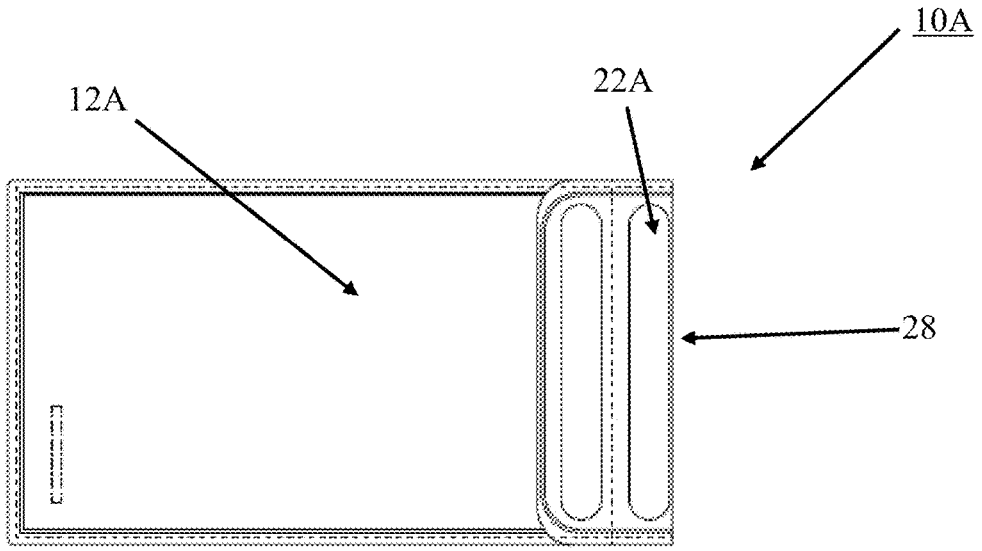
FIG. 8 is a front view of the Bi-fold wallet in the unfolded position illustrating a fully inserted smartphone housed within the faraday bag with the side folding flap in the closed position in accordance with the present invention.

Referring now to FIGS. 5 and 6, there is shown and illustrated the bi-fold wallet 10B in the folded position with the front portion 12B and back portion 14B illustrating the wallet size when the folding flap 20B is in the closed or in the folded position. Referring now to FIG. 7 there is shown and illustrated a front portion 12 of the Bi-fold wallet 10 in the unfolded position illustrating the insertion of a smartphone 34 into the faraday bag portion 28 of the bi-fold wallet 10 for housing the smartphone 34 in accordance with the present invention. Referring now to FIG. 8 there is shown and illustrated a front portion 12A of the Bi-fold wallet 10A in the unfolded position illustrating a fully inserted smartphone 34 housed within the faraday bag 28 with the side folding flap 20A in the closed position in accordance with the present invention.

In summary, different materials and techniques may be assembled and used interiorly within the interior compartments of a bi-fold wallet for EM shielding to block errant electromagnetic interference (EMI). It should be understood that it is not necessary to have a complete, continuous enclosure so long as any openings are smaller than the electromagnetic waves that are to be blocked which by way of example may be a layered Faraday nickel copper mesh. Additionally, magnetic materials may be used for EM shielding in environments where the magnetic fields are slowly varied below the 100 Khz range. The use of magnetic materials draws the EMI into the magnetic field of the shielding and blocks other transmission.

The bi-fold wallet of the present invention is used for carrying items typically including personal identification, credit cards and/or currency. The bi-fold wallet may be carried containing RF emitting debit/credit while being protected against any RF hacking attempts. The bi-fold wallet may be comprised of portions, such as a front portion and a rear portion. These portions may comprise an outer material on the exterior and one or more portions of inner material in a defined interior incorporating RF blocking technology that is layered between an inner soft filler material attached to the inside of the outer material.

The bi-fold wallets inner filler material may be a thin sheet of diamond Faraday material to prevent abrasion covering one or more layers of RF blocking material such as a Faraday nickel copper alloy mesh. This soft filler is typically not visible to the device user. In one embodiment, two soft filler sheets are used, one on either side of each RF blocking material. The bi-fold wallets outer material may be on its exterior portions, forming the front and back of the bi-fold wallet may be water and dust proof nylon ripstop. The RF blocking material may be cut to a size and shape to ensure a perfect fit cut for maximum RF Blocking.

It should be understood that many variations are possible based on the disclosure herein. Although features and elements are described above in particular combinations, each feature or element can be used alone without the other features and elements or in various combinations with or without other features and elements.

What is claimed is:

1. A bi-fold wallet incorporating electromagnetic shielding, comprising:

a front portion attached to a back portion wherein said attachment forms one or of more interiorly defined compartments and a side folding flap at one end wherein said one or more interiorly defined compartments are layered with an RF blocking material, wherein said one or more interiorly defined compartments define a second interior compartment for interiorly and securely housing a smartphone when the bi-fold wallet is in an unfolded position and said side folding flap is in a closed position.

* * * * *